US005282374A

United States Patent [19]

Kojima et al.

[11] Patent Number: 5,282,374

[45] Date of Patent: Feb. 1, 1994

[54] CONTINUOUS FORGING APPARATUS FOR CAST STRAND

[75] Inventors: Shinji Kojima; Hisakazu Mizota; Toshitane Matsukawa; Toshio Fujimura; Kouichi Kushida; Yoshio Yoshimoto; Noriaki Inoue, all of Kurashiki, Japan

[73] Assignee: Kawasaki Steel Corporation, Japan

[21] Appl. No.: 949,500

[22] PCT Filed: Feb. 26, 1992

[86] PCT No.: PCT/JP92/00207

§ 371 Date: Oct. 26, 1992

§ 102(e) Date: Oct. 26, 1992

[87] PCT Pub. No.: WO92/14567

PCT Pub. Date: Sep. 3, 1992

[30] Foreign Application Priority Data

Feb. 26, 1991 [JP] Japan ..... 3-53230
Feb. 27, 1991 [JP] Japan ..... 3-53637
Feb. 27, 1991 [JP] Japan ..... 3-53638

[51] Int. Cl.[5] ..... B21J 1/02; B21J 9/12; B21J 9/18

[52] U.S. Cl. ..... 72/407; 72/452; 72/453.01; 164/476

[58] Field of Search ..... 164/417, 476, 413, 412; 72/407, 452, 453.01

[56] References Cited

U.S. PATENT DOCUMENTS

| | | | |
|---|---|---|---|
| 3,857,272 | 12/1974 | Voitsekhovsky | 72/407 |
| 4,578,983 | 4/1986 | Kimura | 72/407 |
| 5,168,739 | 12/1992 | Heitze | 72/407 |
| 5,195,351 | 3/1993 | Heitze | 72/407 |

FOREIGN PATENT DOCUMENTS

| | | | |
|---|---|---|---|
| 61-238450 | 10/1986 | Japan . | |
| 63-303670 | 12/1988 | Japan . | |
| 2-70363 | 3/1990 | Japan . | |
| 2-182361 | 7/1990 | Japan . | |
| 3281050 | 12/1991 | Japan | 164/476 |
| 1171169 | 8/1985 | U.S.S.R. | 72/407 |

*Primary Examiner*—Paula A. Bradley
*Assistant Examiner*—Erik R. Puknys
*Attorney, Agent, or Firm*—Austin R. Miller

[57] ABSTRACT

According to the present invention, in case of continuously forging a cast strand in its final solidification region, in order to forge the cast strand with uniform reduction amounts on front and rear sides of the strand notwithstanding the cast strand is wrapped or floated during movement of the cast strand being drawn from molds, the head end oil chamber and the rod end oil chamber of each of positioning cylinders for adjusting the positions of anvils are connected by means of hydraulic oil passages having a selector valve, and further the hydraulic oil passages connected to the head end oil chambers of the positioning cylinders are connected to each other by means of a first bypass line.

11 Claims, 24 Drawing Sheets

CONTINUOUS FORGING APPARATUS FOR CAST STRAND

TECHNICAL FIELD

The present invention relates to a continuous forging apparatus suitable for forging a cast strand produced by continuous casting in its solidifying completion region during the process of drawing the cast strand from continuous cast molds.

BACKGROUND ART

A continuous forging apparatus for forging a cast strand produced by continuous casting in its final solidification region during the process of drawing the cast strand from casting molds has been known, for example, as disclosed in Japanese Patent Application Laid-open No. 2-70,363. With such an apparatus, it is possible to mitigate center segregations and porous shrinkage cavities in cast strands, thereby advantageously improving the internal quality of products. However, the apparatus itself includes the following disadvantages and problems to be resolved.

(1) It is sometimes impossible to forge a cast strand with uniform forging reduction amounts on both sides by means of forging anvils because of warping of the cast strand to deviate from its transfer line. Such a warp of the cast strand is caused by uneven cooling in a secondary cooling zone for cooling the cast strand, wrong correction at junctions between strands of different steel kinds or at pinch roll arranged zones or the like.

(2) The forging reduction force sometimes acts upon the apparatus as an external force rather than a working force for a cast strand. Therefore, the apparatus has a risk of being damaged to shorten its service life considerably.

(3) With an apparatus having hydraulic cylinders arranged for the purpose of preventing overload and adjusting the distance between anvils, in the case that the inner pressure in cylinders is different as high as 200 $kg/cm^2$ depending on when forging is being effected or before the forging, volume of an hydraulic oil may change of the order of about 1% by compression. Even the anvils start to move away from each other from their positions nearest to each other, the reduction force remains corresponding to the compression of the hydraulic oil. Such a reduction force acts as a torque rotating the crankshaft in the reverse direction (simply referred to hereinafter "negative torque"). As there are clearances (backlashes) between tooth surfaces of gears in mesh with each other in a speed reduction device connected to the crankshaft, the torque rotating the crankshaft in the reverse direction causes the tooth surfaces of the gears to collide with each other so that strange sound (striking sound) and vibration occur which detrimentally affect the service life of the apparatus itself and make difficult the stable working of strands by the apparatus.

In order to solve the problems (1) and (2) as described above, the position control can be performed, for example, by the use of the hydraulic servo valve and the hydraulic control mechanism disclosed in Japanese Patent Application Laid-open No. 60-82,222. However, this system is expensive to increase the installation cost unavoidably. Moreover, hydraulic oil for controlling the apparatus must be kept in a highly clean state which requires a troublesome maintenance. Therefore, the system for hydraulically controlling the apparatus must be separated from general hydraulic systems. Such an arrangement is not suitable for practical use. There has been no means to overcome the problem (3).

It is an object of the invention to provide a forging apparatus for forging a cast strand produced by continuous casting during the process of drawing the cast strand from continuous casting molds, which is able to work the cast strand with uniform forging reduction amounts on both sides by causing anvils to follow the cast strand even if the cast strand is warped or floated and is also able to considerably mitigate strange sound and vibration of the installation occurring in the forging.

DISCLOSURE OF INVENTION

The present invention relates to a cast strand continuous forging apparatus including a pair of anvils for continuously forging a cast strand drawn from continuous casting molds in its final solidifying zone by repeated reciprocative movements of the anvils toward and away from each other on both sides of the cast strand, wherein the apparatus comprises a main frame having one anvil fixed thereto, a subframe having the other anvil fixed thereto and movable along guide members of the main frame, a crankshaft causing the reciprocative movements of the anvils toward and away from each other, links connecting the crankshaft to the main frame and the subframe, respectively, positioning cylinders arranged on the main frame and the subframe, respectively, for adjusting the distance between the anvils, hydraulic oil passages having a selector valve and connecting a rod end oil chamber and a head end oil chamber of each of the positioning cylinders, and a first bypass line connecting the hydraulic oil passages connected to the head end oil chambers of the positioning cylinders.

According to the invention, in the cast strand continuous forging apparatus as described above, the first bypass line preferably comprises pilot check valves arranged in opposite directions to each other.

Moreover, each of the positioning cylinders preferably comprises balance cylinders for preventing movements of the rod of the positioning cylinder by gravity.

In order to forge a cast strand with predetermined reduction amounts, moreover, each of the positioning cylinders preferably comprises a displacement meter for detecting displacement of the rod of the positioning cylinder It is preferable to arrange flow control valves and relief valves in the hydraulic oil passages. The hydraulic oil passages connected to the head end oil chamber and the rod end oil chamber of each of the positioning cylinders are preferably connected by a return circuit having pilot check valves According to the invention, in the cast strand continuous forging apparatus as above described, the hydraulic oil passages connected to the rod end oil chambers of the positioning cylinders may be connected by a second bypass line In this case, the second bypass line preferably comprises pilot check valves arranged in opposite directions to each other Moreover, the apparatus constructed as above described preferably comprises braking means for braking the reciprocative movements of the anvils toward and away from each other or at least two sets of anvils different in starting time of the forging FIG. 1 illustrates a forging apparatus according to the invention, wherein a cast strand S is forged and pressed in its thickness directions on both sides (on its lower and upper surfaces) by an anvil 1b fixed to a main frame 2 and an anvil 1a fixed to a subframe 3 movable along guide members 2a on the main frame 2. A link 5a is pivotally connected with its one end to the main frame 2 and with the other end to a crankshaft 4 and a link 5b is pivotally connected with its one end to the subframe 3 and with the other end to the crankshaft 4. Positioning cylinders 6 and 7 are fixed to the main frame 2 and the subframe 3, respectively, and include head end oil chambers 6a and 7a and rod end oil chambers 6b and 7b, respectively, for adjusting the distance between the anvils 1a and 1b. Hydraulic oil passages 8a and 8b are connected to the rod end oil chamber 6b and the head end oil chamber 6a of the positioning cylinder 6, respectively, and hydraulic oil passages 8c and 8d are connected to the head end oil chamber 7a and the rod end oil chamber 7b of the positioning cylinder 7, respectively. One set of the hydraulic oil passages 8a and 8b is provided with a selector valve C having a tank port T and pressure port P exchangeable over with each other. The other set of the hydraulic oil passages 8c and 8d is also provided with a selector valve C having the same construction. The head end oil chambers 6a and 7a of the positioning cylinders 6 and 7 are connected by a bypass line 9 (referred to "first bypass line" hereinafter) having therein pilot check valves 10 and 11. To the check valves 10 and 11 is connected a pressure port $P_1$ of a pilot valve in a hydraulic circuit, which makes it possible to supply hydraulic oil. Balance cylinders 12 are interposed between the subframe 3 and the anvil 1a. The balance cylinders 12 have lifting force corresponding to the total weight of the anvil 1a and the piston rod of the positioning cylinder 7 for preventing the piston rod of the positioning cylinder 7 from freely falling by gravity and eliminating any play between the link 5b and the subframe 3. Displacement meters 13 and 14 serve to detect displaced distances of the piston rods of the positioning cylinders 6 and 7, respectively. Flow control valves 15 and 16, for example, proportional magnetic valves serve to effect adjustment of the distance between the anvils 1a and 1b and individual positional adjustment of the anvils. With the flow control valves 15 and 16, it is individually possible to adjust moving speeds of the anvils in positional adjustment. Relief valves 17 and 18 serve to exhaust hydraulic oil out of the system in the event that the pressure in the positioning cylinders exceeds predetermined values due to an overload acting upon the anvils, which may occur when a cast strand S is forged notwithstanding its temperature has fallen to an unduly lower level. Pressure detectors 19 and 20 are provided in the hydraulic oil passages 8b and 8c for detecting extraordinary pressures in the head end fluid chambers 6a and 7a of the positioning cylinders 6 and 7.

When the crankshaft 4 is rotated by driving means, the main frame 2 and the subframe 3 which are connected through the links 5a and 5b to the crankshaft 4 are moved vertically. Since the anvils 1a and 1b are fixed to the subframe 3 and the main frame 2, respectively, the anvils 1a and 1b are repeatedly reciprocatively moved toward and away from each other in synchronism with the movements of the main frame and subframe, with the result that the cast strand S is forged.

FIG. 2 illustrates the forging apparatus viewed from it front side.

According to the invention, the hydraulic oil passages 8b and 8c connected to the head end oil chambers 6a and 7a of the positioning cylinders 6 and 7, respectively, are connected to each other by means of the first bypass line 9 provided with the pilot check valves 10 and 11. With this arrangement, when the cast strand S is reduced by forging, the pilot check valves are operated to flow hydraulic oil between the head end oil chambers 6a and 7a. As a result, the inner pressures in the head end oil chambers of the positioning cylinders 6 and 7 are always equal to each other so that the positions of the anvils are automatically corrected. Therefore, it is possible to forge the cast strand uniformly on its upper and lower sides, even if the cast strand S upwardly warps or floats to change its position so that distances from the upper and lower surfaces of the strand S to the anvils are different.

In the apparatus constructed in a manner that anvils 1a and 1b for forging the cast strand S are fixed to the frames 2 and 3 through the positioning cylinders 6 and 7, the compressed degree of hydraulic oil changes in response to variations in the inner pressure in the head end oil chambers of the positioning cylinders 6 and 7 depending on whether reduction by forging is being performed or not. As a result, the positions of the piston rods of the positioning cylinders 6 and 7 are changed with amplitudes, if they are slight (of the order of 2 to 3 mm) every period of movement of the anvils toward and away from each other in forging. Such slight amplitudes of the positions of the piston rods become disturbance signals which make it impossible to hold the positions of the anvils exactly in forging operation. In order to overcome this problem, according to the invention, the positions of the anvils are suitably adjusted on the basis of values detected by the displacement meters 13 and 14 to obtain predetermined reduction amounts of the cast strand.

FIG. 3 illustrates the hydraulic circuit under the condition for decreasing the distance between the upper and lower anvils 1a and 1b to increase the reduction amount of the cast strand. In order to effect such an operation, the pilot check valves 10 and 11 in the first bypass line 9 are maintained closed and the selector valves C are changed over to a #3 position to feed hydraulic oil into the head end oil chambers 6a and 7a of the positioning cylinders 6 and 7, respectively, so as to obtain the predetermined reduction amount of the cast strand.

FIG. 4 illustrates the hydraulic circuit under a condition for increasing the distance between the upper and lower anvils 1a and 1b to decrease the reduction amount of the cast strand. In order to effect such an operation, the selector valves C are changed over to a #4 position so as to feed hydraulic oil into the rod end oil chambers 6b and 7b of the positioning cylinders 6 and 7 to bring the anvils into positions spaced to each other with a predetermined distance. The pilot check valves 10 and 11 in the first bypass line 9 are maintained closed in the same manner as in FIG. 3.

If hydraulic oil leaks from the positioning cylinders 6 and 7 so that the reduction of the cast strand deviates from a predetermined value, both the cylinders 6 and 7 can be replenished with required amounts of hydraulic oil by one operation for a fine adjustment without requiring individual operations because of the first bypass line 9 permitting hydraulic oil to flow between the hydraulic oil passages 8b and 8c for the lower and upper anvils 1a and 1b. It is advantageous that the number of times of changing over operations of the selector valves C can be minimized.

FIG. 5 illustrates the hydraulic circuit under the condition for decreasing the distance between the upper and lower anvils 1*a* and 1*b* to adjust the reduction amount of the cast strand finely. In this case, the pilot check valves 10 and 11 in the first bypass line 9 are controlled to permit hydraulic oil to flow between the head end oil chambers 6*a* and 7*a* of the positioning cylinders 6 and 7.

FIG. 6 illustrates the hydraulic circuit under the condition for increasing the distance between the upper and lower anvils 1*a* and 1*b* to adjust the reduction of the cast strand finely. In this case, the selector valves C are changed over to a #C position to perform the same operation as that in FIG. 5.

FIG. 7 illustrates the hydraulic circuits in which the anvils 1*a* and 1*b* are maintained in forging reduction operation. In this state, the selector valves C are changed over to the #2 position to lock the hydraulic oil passages 8*a*, 8*b*, 8*c* and 8*d* communicating with the oil chambers 6*a*, 7*a*, 6*b* and 7*b* of the positioning cylinders 6 and 7 so as to avoid any leakage of hydraulic oil to keep the closed pressure in the positioning cylinders. On the other hand, the pilot check valves 10 and 11 in the first bypass line 9 are maintained to permit hydraulic oil to flow therethrough.

In the case that the forging is continuously effected, the displacement meter reads the decrease in volume of hydraulic oil due to compression and leakage, and the selector valves C are controlled so as to obtain the condition of the hydraulic circuit shown in FIG. 5 to replenish hydraulic oil into the head end oil chambers, thereby maintaining a constant volume of hydraulic oil in the head end oil chamber 6*a* and 7*a*.

As the reduction amount of the cast strand S is determined at the moment when the anvils 1*a* and 1*b* are moved toward each other to a minimum spaced distance. It is preferable to set the positions of the anvils in this state.

Moreover, mechanical elongations such as the elongations of the guide members 2*a* of the main frame 2 cause errors in operation which are determined by the reduction force acting upon the cast strand C. Therefore, it is preferable to correct the reduction amount suitably on the basis of the value measured by the displacement meters 13 and 14 minus the mechanical elongation.

In replenishing and exhausting hydraulic oil into and out of the hydraulic oil passages 8*a*, 8*b*, 8*c* and 8*d* for the purpose of adjusting the distance between the anvils 1*a* and 1*b* or the reduction amount of the cast strand S in forging, it is preferable to perform such an operation when the forging is not carried out in consideration of the compression of the hydraulic oil.

FIG. 8 illustrates the state that the anvil 1*a* has just contacted the cast strand S to start the forging. On the other hand, FIG. 9 illustrates the state that the forging has just finished by the anvil 1*a* and it is about to leave the cast strand S. It is preferable to effect the replenishing and exhausting of hydraulic oil into and out of the hydraulic oil passages within the range of $\beta<\theta<360°+\alpha$, where $\theta$ is a rotating angle of the crankshaft 4 of the forging apparatus in FIG. 9.

In FIG. 9, a distance b is the height of hydraulic oil in the positioning cylinder 7 when the anvils 1*a* and 1*b* have approached each other to the nearest distance, and x is the height of hydraulic oil corresponding to the compressed amount thereof at that time. At the moment when hydraulic oil has just expanded to the amount corresponding to the height x, the anvils 1*a* and 1*b* start to leave the cast strand, and the rotated angle of the crankshaft 4 is $\beta$.

At the time when the forging starts, the set distance between the anvils is adjusted according to the procedure shown in FIG. 10.

Only the upper anvil 1*a* is shown in FIG. 10 since the upper and lower anvils are substantially the same in function. For the first working operation, hydraulic oil is fed into the positioning cylinders with the hydraulic circuit in the state shown in FIG. 3 such that the anvil is displaced through a distance corresponding to A+B in FIG. 10 from the waiting position and the working operation is performed with the hydraulic circuit shown in FIG. 7. The reduction of the cast strand effected by the anvil 1*a* in this case corresponds to B in FIG. 10.

For the second working operation, hydraulic oil is supplied to the positioning cylinders with the hydraulic circuit in the state shown in FIG. 4 to obtain a further reduction of the cast strand corresponding to C in FIG. 10 during movement of the anvils away from each other after the first working operation. For the third working operation, hydraulic oil is supplied into the positioning cylinders to obtain the reduction corresponding to D in FIG. 10 and the working operation is performed with the hydraulic circuit shown in FIG. 7 in the same manner. For the fourth working operation and so forth in the steady state, the working operation is continuously performed to obtain the reduction of the cast strand corresponding to B+C+D. Reference 1*a*' in FIG. 10 shows the anvil which is furthest from the other anvil in forging in the steady state. The moving speed of the anvil for changing the reduction of the cast strand is controlled by the flow control valves 15 and 16.

According to the invention, a cast strand S can be uniformly reduced in its width directions by the forging operation by permitting hydraulic oil to flow between the head end oil chambers 6*a* and 7*a* of the positioning cylinders 6 and 7. In this case, particularly, the positioning cylinders are directly subjected to the forging force so that they are liable to have large diameters. Therefore, if smaller positioning cylinders can be employed, it is very advantageous.

In order to employ smaller positioning cylinders, it may be conceived to raise the maximum pressure of the oil in use. In practice, however, the pressure of the order of 300 kg/cm$^2$ is maximum in consideration of the stable operation of an installations relying upon pressure resistance of hoses used for supplying hydraulic oil. If the reduction force is 2000 t, the cylinder diameter is of the order of 950 mm. In the case that the apparatus provided with such large diameter positioning cylinders is used for the forging, there are following disadvantages.

In order to bring an anvil from its waiting position into forging position in the steady state, it is needed to replenish and exhaust hydraulic fluid into and out of the positioning cylinders as shown in FIG. 10. However, if large diameter positioning cylinders are employed, the great amount of hydraulic oil for actuating the cylinders is needed which requires a hydraulic supply including a pump having a great capacity resulting in high installation cost. On the other hand, after the forging once comes into a steady state, it is sufficient to move the anvil to an slight extent capable of correcting errors in reduction of the cast strand for which purpose only a little amount of hydraulic oil is required. The hydraulic supply having the great capacity only for starting the forging is superfluous as an installation.

In order to overcome this problem, according to the invention by using the select valves C having the #3 position capable of communicating the hydraulic oil passages 8a and 8d with each other to permit hydraulic oil to flow between the head end oil chamber 6a and the rod end oil chamber 6b and between the head end oil chamber 7a and rod end oil chamber 7b to form a differential circuit as shown in FIG. 11, thereby reducing the required amount of hydraulic oil. In this case, the hydraulic oil passages 8a and 8b are connected by a return circuit 25 having pilot check valves 21 and 22 to permit hydraulic oil to flow between the passages 8a and 8b, while the hydraulic oil passages 8c and 8d are connected by a return circuit 26 having pilot check valves 23 and 24 to permit hydraulic oil to flow between the passages 8c and 8d. The hydraulic oil passages 8a and 8d are connected by a second bypass line 27 having pilot check valves 28 and 29.

The "differential circuit" referred herein is for obtaining a driving force corresponding to product of pressure of hydraulic oil and difference between areas on the head side and rod side of the piston when hydraulic oil is fed into the head end oil chamber and the rod end oil chamber. With such a measure, although the driving force decreases, hydraulic oil to be supplied can be reduced by the rate of {(area on the head side—area on the rod side)/area on the head side}. This hydraulic circuit is effective to reduce the hydraulic oil supply amount in operation.

In more detail, the cut down ratio of hydraulic oil is indicated by $(\gamma)=(A_H-A_D)/A_H=A_R/A_H$, where $A_H$ is the area on the head side of the piston, $A_D$ is the area on the rod side of the position and $A_R$ is the sectional area of the piston rod. The thrust force for driving the anvil is also reduced with the ratio $\gamma$. However, as the operation for moving the anvil is effected when the apparatus does not perform the forging, a small force corresponding to the weight of parts associated with the anvil suffices to move the anvil, which is much smaller than the forging reduction force. Therefore, the differential circuit sufficiently serves to achieve its object. In FIG. 12, moreover, the anvil K in solid lines is shown in its waiting position, while the anvil K' in chain lines is shown in steady forging position. Alphabet t illustrates the clearance between a cast strand and the anvil in the waiting position. Alphabet T is a feed of the anvil in the steady forging.

The differential circuit is accomplished by changing over the selector valves C into the #3 position and used for the purpose of making smaller the distance between the anvils (in reduction directions of the cast strand S). In order to make larger the distance between the anvils, the adjustment can be effected only by lowering the pressure in the head end oil chamber by the use of the own weight ($W_e$) of the main frame applied to the piston rod of the cylinder and the lifting force (F) of the balance cylinders 12 without requiring any supply of the oil from the hydraulic source. Therefore, the capacity of the hydraulic source can be decreased and the possibility of malfunction due to failure of hydraulic equipment can be reduced. In this case, the return circuits 25 and 26 are maintained to permit hydraulic oil to flow therethrough.

In order to set the lifting force (F) of the balance cylinders 12, it may be balanced with the own weight of the frame 2 because the first bypass line 9 of the positioning cylinders 6 and 7 is maintained to permit hydraulic oil to flow therethrough when the forging is performed. In this manner, any uneven abutment of the anvil against a cast strand can be avoided so that smooth reduction of the cast strand can be ensured. The set value of the lifting force (F) is preferably in the following range in consideration of the pressure losses in the hydraulic oil passages and sliding resistance of the cylinders.

$$0.7\,(W_e+W_u)\leqq F\leqq 1.3\,(W_e+W_u),$$

where $W_e$ is the own weight of the main frame applied to the rod of the positioning cylinder 3a, and $W_u$ is the own weight of the support base and the like for the anvil acting upon the rod of the positioning cylinder 3b.

In the case that the positioning is effected for making smaller the distance between the anvils (movement in the reduction directions) with the hydraulic circuit shown in FIG. 11, the selector valves C are changed over into a #3 position to form the differential circuit, and the pilot check valves 21, 22, 23 and 24 of the return circuits 25 and 26, the pilot check valves 10 and 11 of the first bypass line 9 and the pilot check valves 28 and 29 of the second bypass line 27 are all closed as shown in FIG. 13. Under this condition, the amount of the hydraulic oil in the positioning cylinders is adjusted. With the above arrangement, slight amount of the hydraulic oil suffices to adjust the positions of the anvils.

In the case that the anvils are positioning to enlarge the distance therebetween (to move away from each other), the selector valves C are changed over to #2, and the pilot check valves 21 and 22 and 23 and 24 in the return circuits 25 and 26 are communicated with each other, while the pilot check valves 10 and 11 and 28 and 29 in the bypass lines 9 and 27 are maintained closed as shown in FIG. 14. With such an arrangement, the anvil 1a is raised by the lifting force (F) of the balance cylinders 12 and hydraulic oil in the head end oil chamber moves into the rod end oil chamber. On the other hand, with respect to the anvil 1b, hydraulic oil in the head end oil chamber moves into the rod end oil chamber under the influence of the own weight ($W_e$) of the main frame 2. Therefore, the distance between the anvils can be simply adjusted without the hydraulic source. In this case, moreover, the extra hydraulic oil which is not supplied into the rod end oil chamber in such an operation is returned to a reservoir through drains D of the return circuits 25 and 26.

FIG. 15 illustrates the flowing of hydraulic oil in finely adjusting the distance between the anvils 1a and 1b for correcting the reduction of a cast strand. In this case, the selector valves C are changed over to the #3 position to form the differential circuit and the pilot check valves in the return circuits 25 and 26 are maintained closed, and further the bypass line 9 and the second bypass line 27 are maintained to permit hydraulic oil to flow therethrough.

FIG. 16 illustrates the state of the flowing of hydraulic oil in finely adjusting the distance between the anvils 1a and 1b for correcting the reduction of the cast strand. In this case, the return circuits 25 and 26 are maintained to permit hydraulic oil to flow between the hydraulic oil passages 8a and 8b and between the hydraulic oil passages 8c and 8d. The adjustment is accomplished only by lowering the pressure in the head end oil chambers without requiring the supply of hydraulic oil from the hydraulic source, because of the lifting force of the balance cylinders and the own weight of the frames as explained referring to FIG. 14. In this case, the bypass lines 9 and 27 are required to be maintained permitting hydraulic oil to flow therethrough.

FIG. 17 illustrates the hydraulic hydraulic circuit under the condition for enabling the anvils to perform the forging. In this case, the selector valves C are changed over to the #3 position so that the inner pressures in the rod end and head end oil chambers of the positioning cylinders 6 and 7 are kept constant and the forging reduction force is supported by the closed pressure in the positioning cylinders. Under this condition, even if a cast strand S is deformed, the forging can be performed with uniform reduction forces from above and below with the aid of the suitable flow of hydraulic oil because of the first and second bypass lines 9 and 27 permitting hydraulic oil to flow between the head end oil chambers 6*a* and 7*a* and between the rod end oil chambers 6*b* and 7*b*. If an excess load acts upon the anvils, the relief valves 17 and 18 are controlled to release hydraulic oil. With such an operation, the hydraulic circuit is changed over into that shown in FIG. 14 to move the anvils 1*a* and 1*b* away from each other rapidly.

FIGS. 18 and 19 illustrates an example of the apparatus constructed as above described further provided with braking means for braking the reciprocative movements of the anvils 1*a* and 1*b* toward and away from each other. A braking device 30 is arranged on the crankshaft 4 to brake the reciprocative movements of the anvils 1*a* and 1*b* toward and away from each other, thereby making small the negative load torque occurring in forging as possible. The crankshaft 4 is driven through a speed reduction device 31 by means of a driving source 32.

With the continuous forging apparatus whose anvils 1*a* and 1*b* are fixed to the frames by means of positioning cylinders 6 and 7, when the anvils 1*a* and 1*b* move from their nearest positions (termination of the forging) to each other into the positions from which they move away from each other, a reduction force corresponding to compression of hydraulic oil in the positioning cylinders 6 and 7 still remains. The reduction force corresponding to the compression of hydraulic oil becomes the negative torque as shown in FIG. 20. It is unavoidable therefore that strange sound and vibration result from backlashes of gears in the speed reduction device 31 connected to the crankshaft 4.

In order to solve this problem, as shown in FIGS. 18 and 19 the braking device 30 is arranged on the crankshaft 4 which is as near to the load changing source as possible to brake the moving speed of the anvil correspondingly to the negative torque or within a range allowable for the speed reduction device and the like (which is somewhat set on a safety side from the negative torque), thereby preventing or at least mitigating the negative torque in the forging operation. It is simple to apply the braking action to the movement of the anvil always during the forging operation. In the case that the power cost of the operation is important, however, it may be preferable to apply the braking action with an electrical sequence only when the anvils are moved away from each other (during which the strange sound will occur).

A drum type or disc type braking device may be used for this purpose. If the braking is continuously applied, a braking device having a cooling system is preferable. It is preferable to arrange the braking device on the shaft I of the speed reduction device 31 as shown in FIG. 21 as near to the load changing source as possible as described above. However, if it is possible to make small backlashes of a gear on the shaft I, the braking device may be arranged on any one of the shafts II to IV. If the braking device can be arranged on a shaft rotated at higher rotating speed in this manner, a braking device having a smaller capacity can be advantageously used.

FIGS. 22 and 23 illustrate an example of the apparatus including at least two sets of anvils (for four strands) having different starting time of forging operation.

With such an apparatus constructed above described, the negative torque occurring every time when the forging by each set of anvils can be canceled by the reduction of a cast strand effected by other set of anvils in different time so that the strange sound of the speed reduction device and vibration of the installation can be effectively mitigated. Moreover, the productivity can be advantageously improved in forging for multi-strands.

FIG. 24 illustrates the change in rotating angle of a crankshaft in forging of a cast strand S in the apparatus. It is assumed that the forging of a cast strand is completed at $\Gamma=90°$ and the reduction force is maintained to the range of an angle $\beta'$owing to the compression of the hydraulic oil and the elongation of the frame and the like. The negative torque will occur within the range of angle $\beta'$, within which the reduction by the other set of anvils is started according to the invention. FIG. 25 illustrates the forging on two cast strand S by anvils 1*a* of two sets of apparatus A and B.

FIG. 26 illustrates load torque curves of the crankshafts 4 of the apparatus shown in FIG. 22. As shown in FIG. 26, the time of termination of the reduction and the time of starting of the reduction are overlapped to bring the total load torque into the positive range or mitigate the negative torque to an extent allowable for the strength and the service life of the speed reduction device. The strange sound and vibration of the installation due to the change in load can be prevented in this manner.

BEST MODE FOR CARRYING OUT THE INVENTION

Example 1

Figure 1:
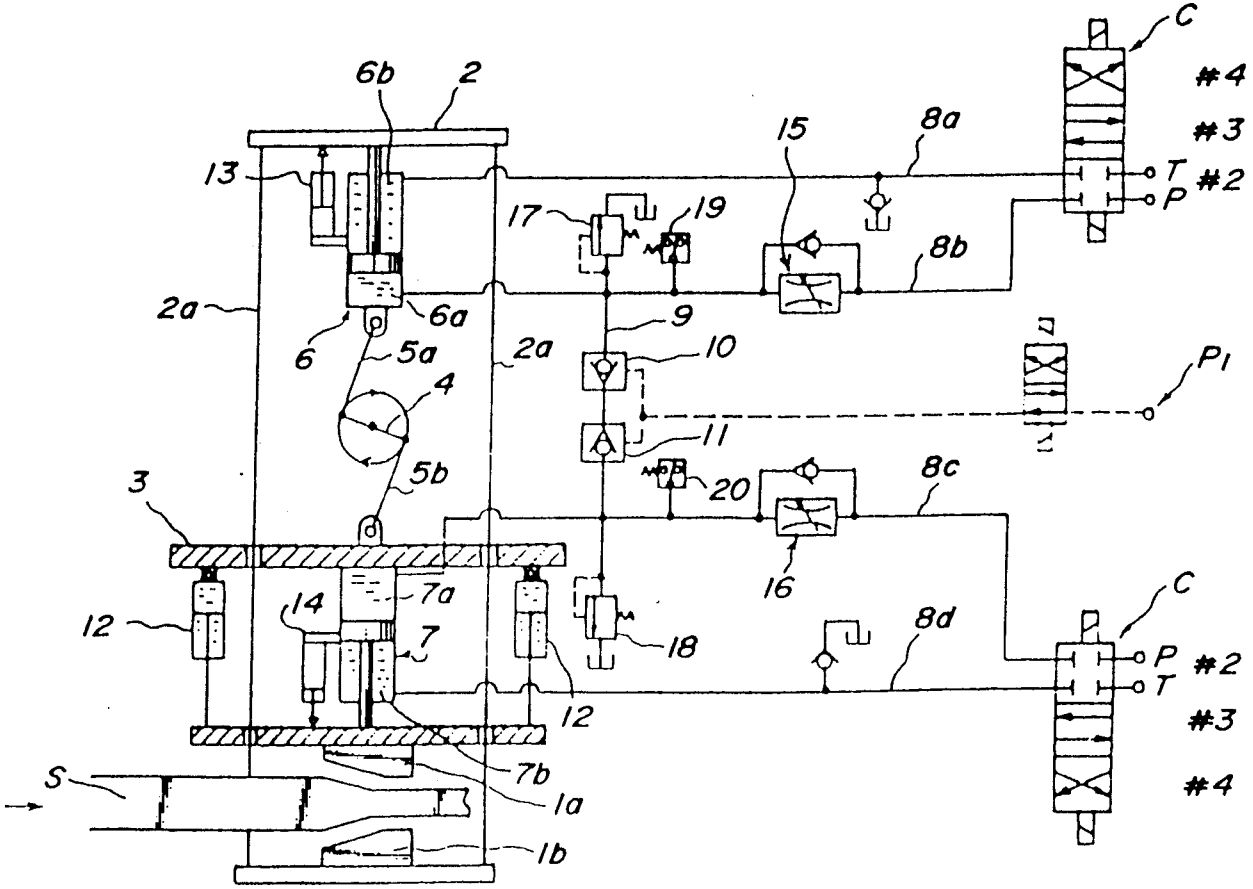
FIG. 1 is a view for explaining the constitution of the forging apparatus according to the invention.
Figure 2:
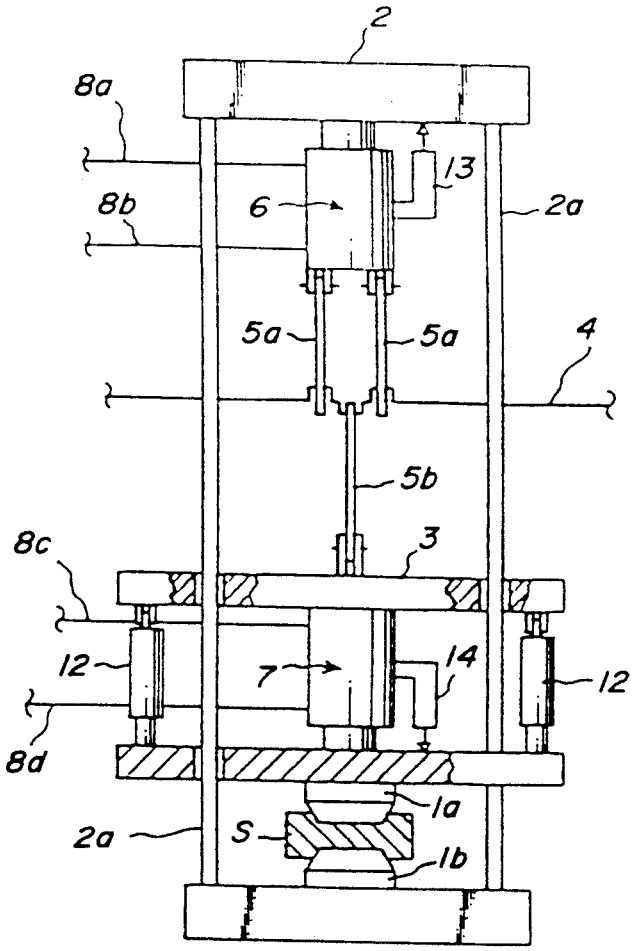
FIG. 2 is a front view of the forging apparatus according to the invention.
Figure 3:
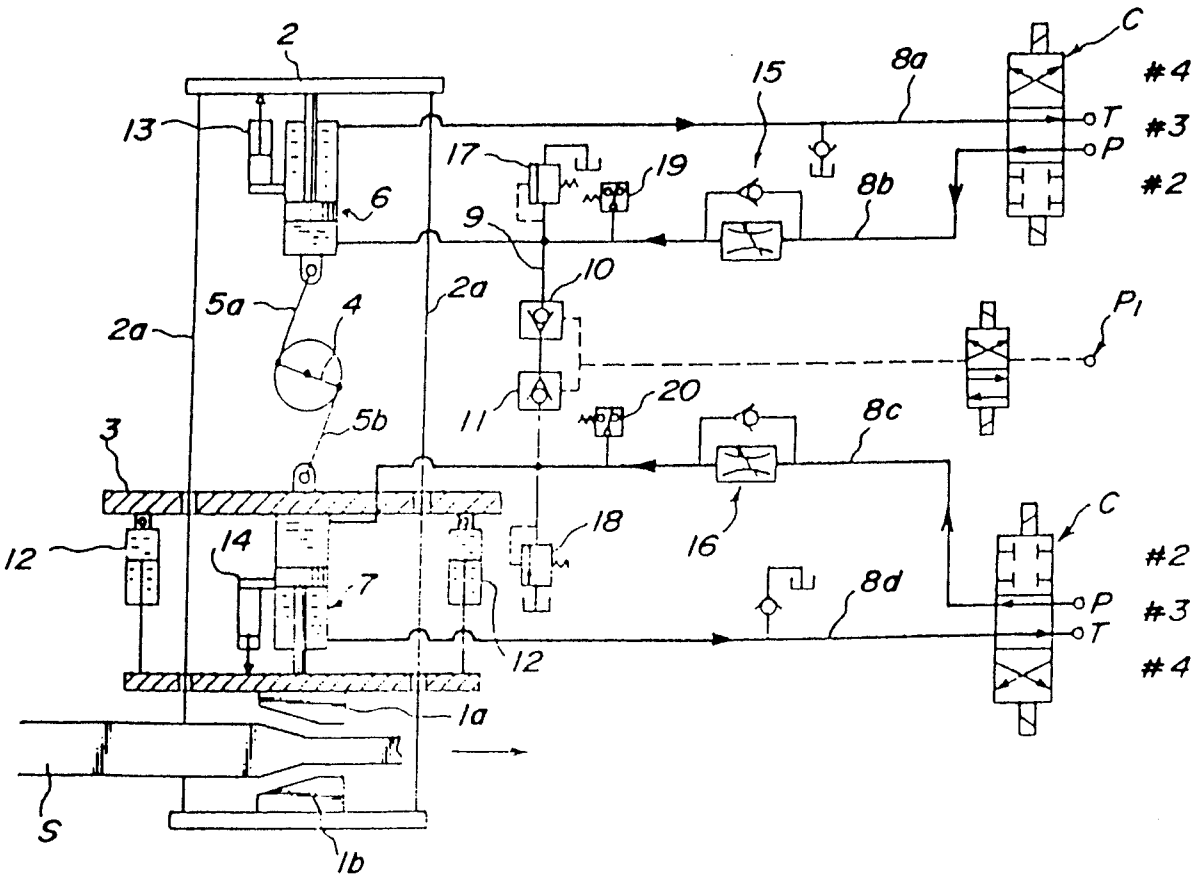
FIG. 3 is a view for explaining the procedure of operation of the apparatus according to the invention.
Figure 4:
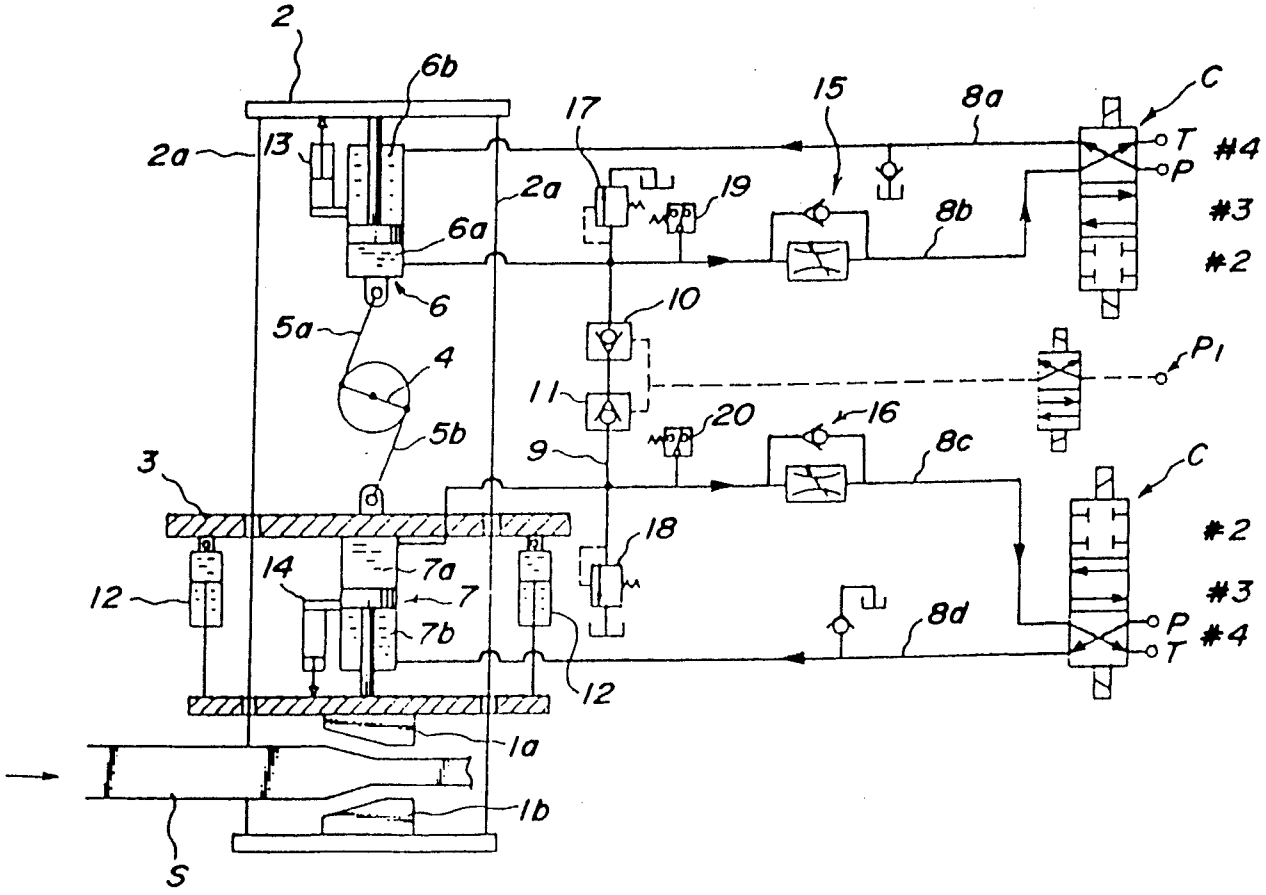
FIG. 4 is a view for explaining the procedure of operation of the apparatus according to the invention.
Figure 5:
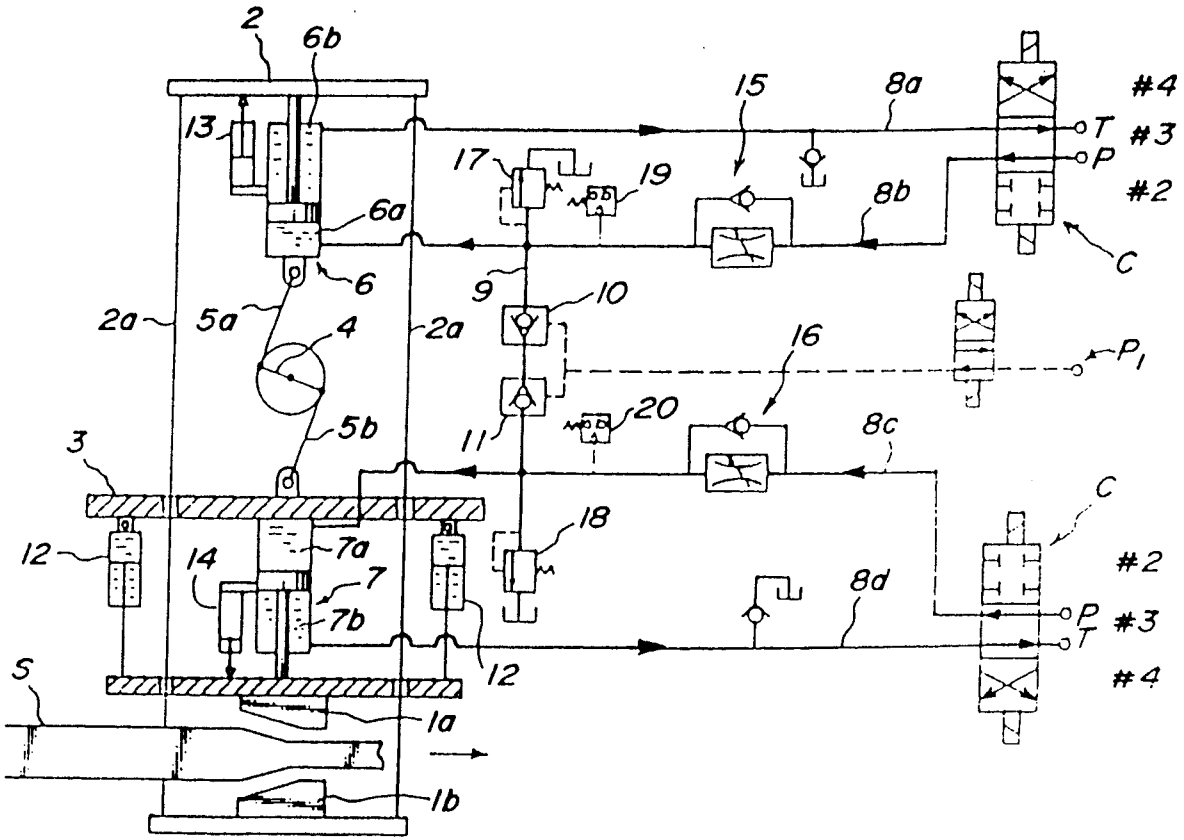
FIG. 5 is a view for explaining the procedure of operation of the apparatus according to the invention.
Figure 6:
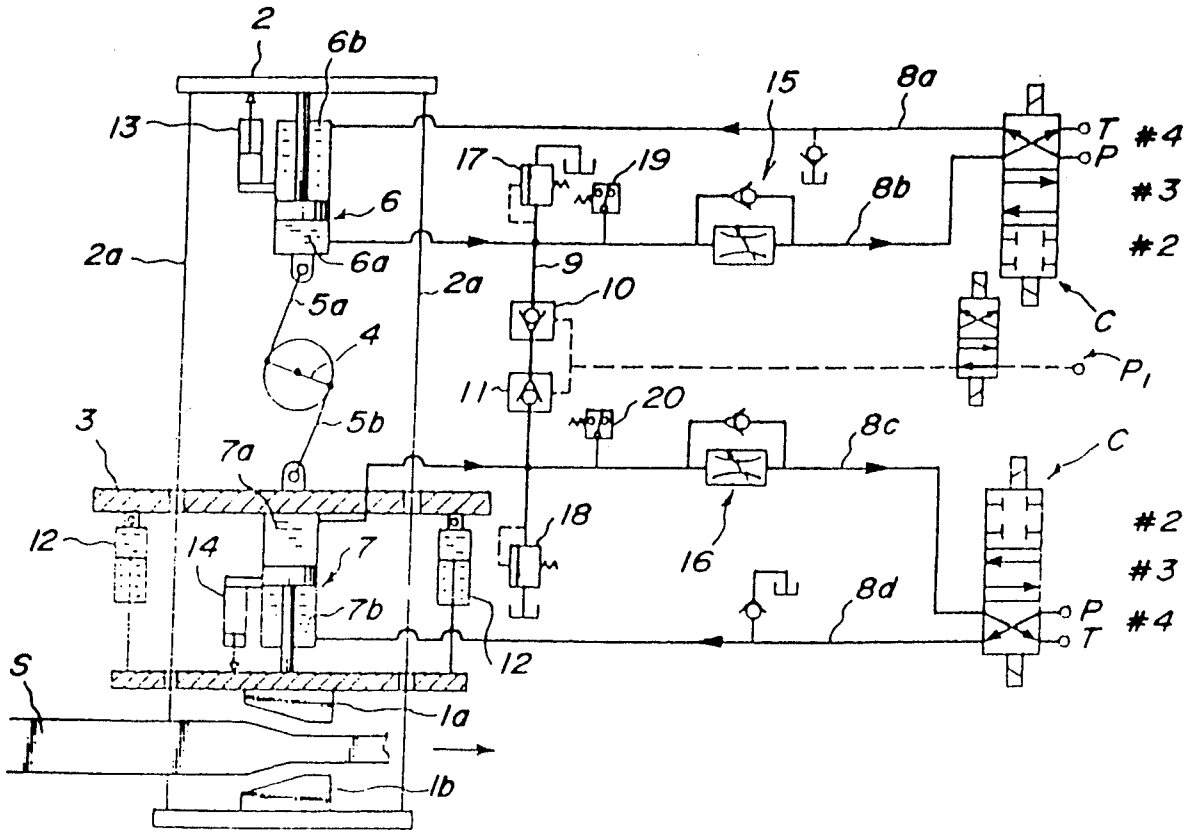
FIG. 6 is a view for explaining the procedure of operation of the apparatus according to the invention.
Figure 7:
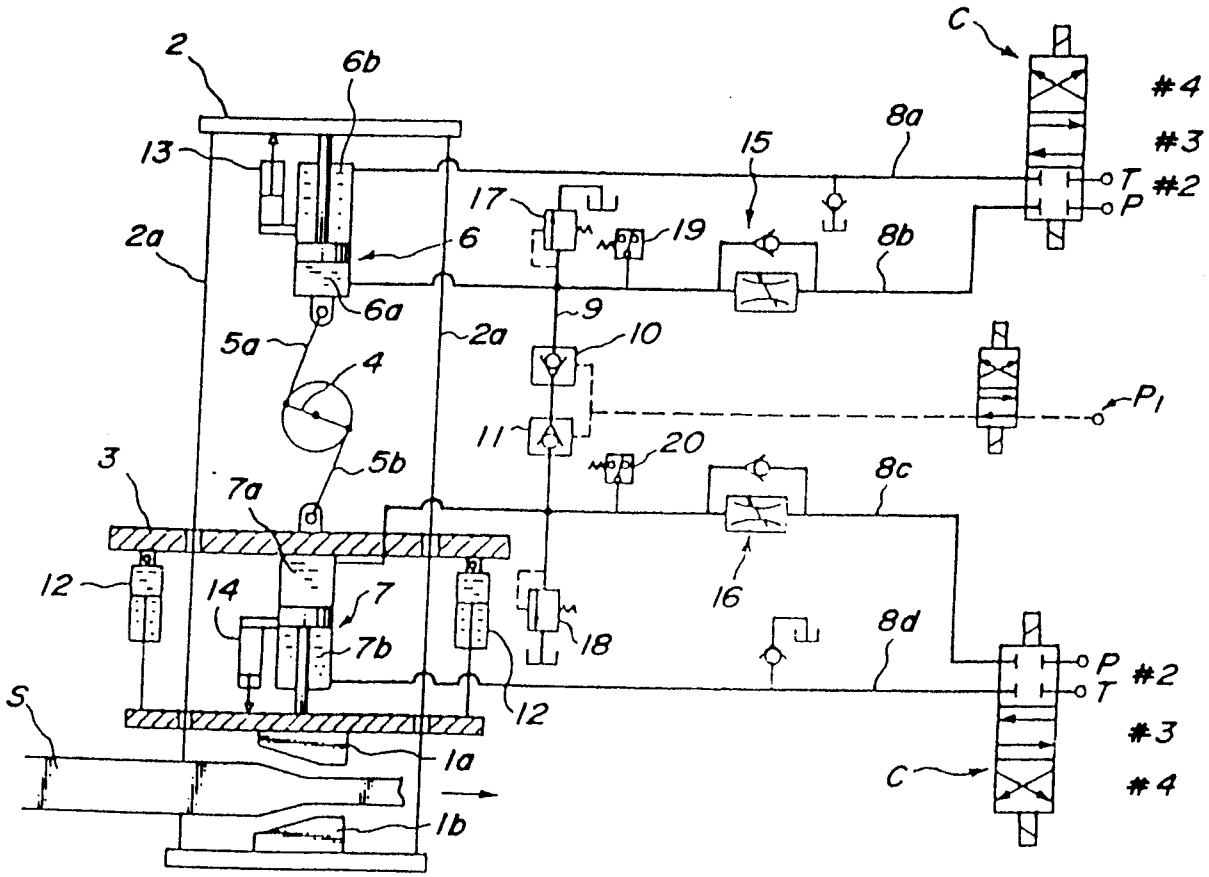
FIG. 7 is a view for explaining the procedure of operation of the apparatus according to the invention.
Figure 8:
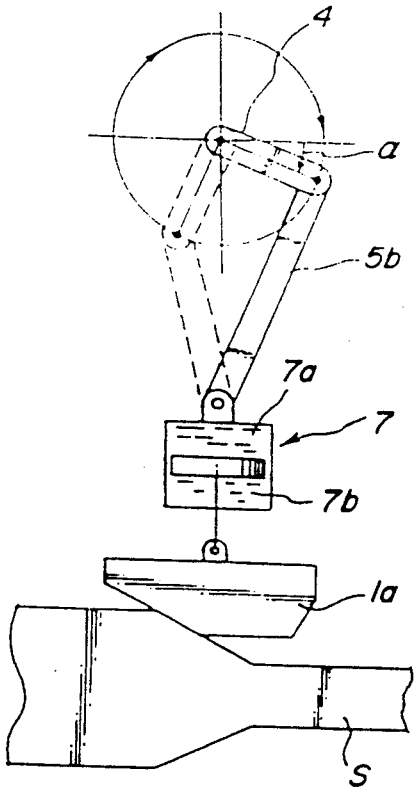
FIG. 8 is a view illustrating the relationship between the position of an anvil and rotated angle of the crankshaft of the apparatus according to the invention.
Figure 9:
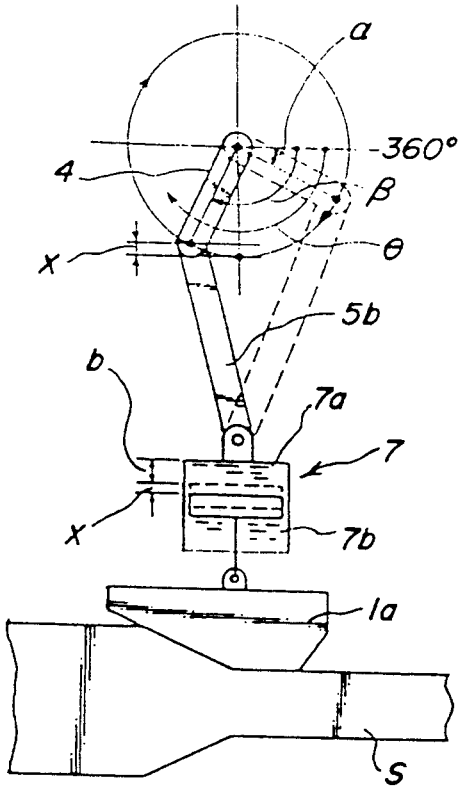
FIG. 9 is a view illustrating the relationship between the position of an anvil and rotated angle of the crankshaft of the apparatus according to the invention.
Figure 10:
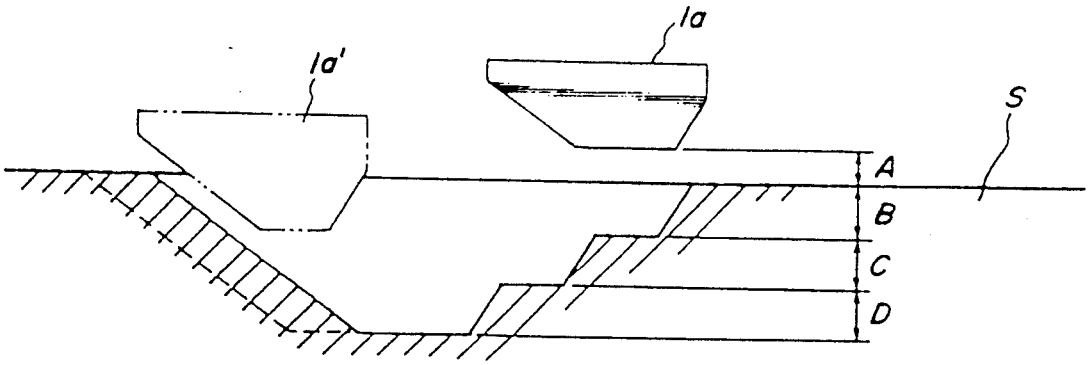
FIG. 10 is a view for explaining the state from the starting the forging to the steady state.
Figure 19:
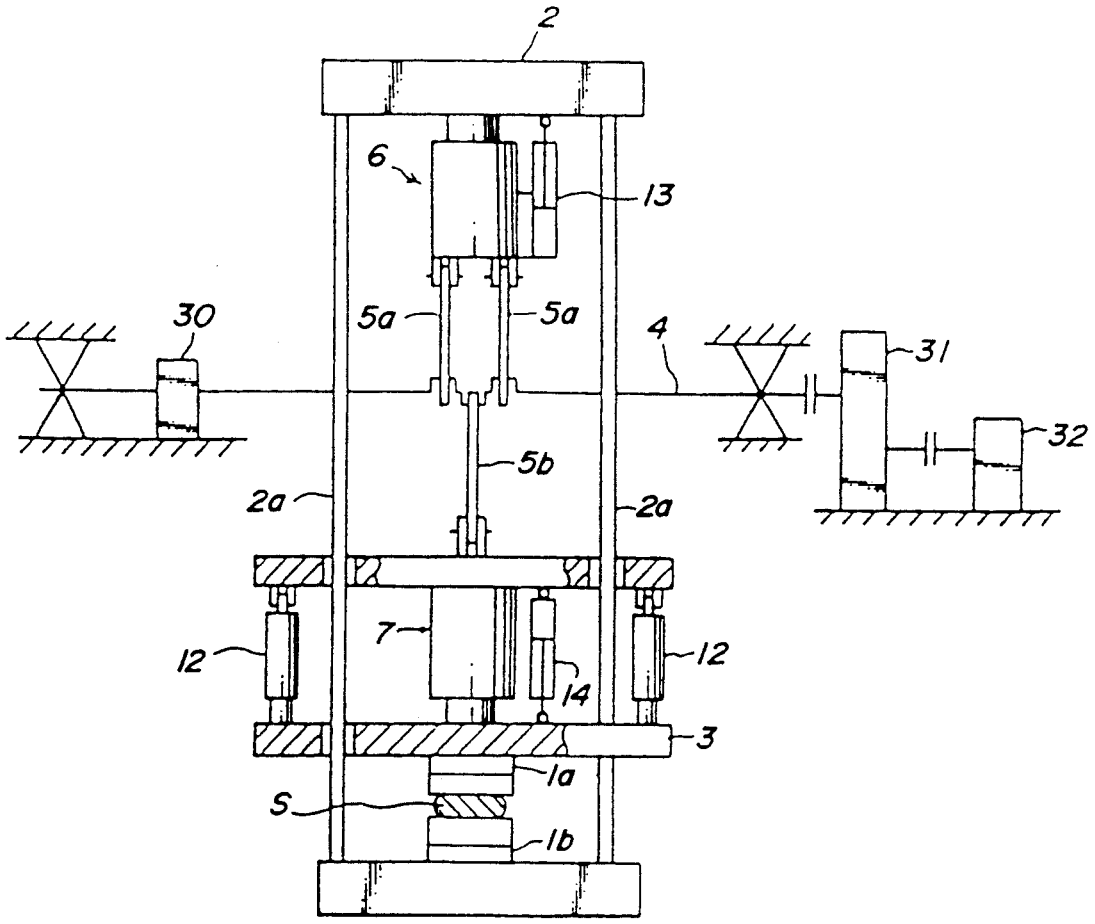
FIG. 19 is a side view illustrating the apparatus shown in FIG. 18.
Figure 20:
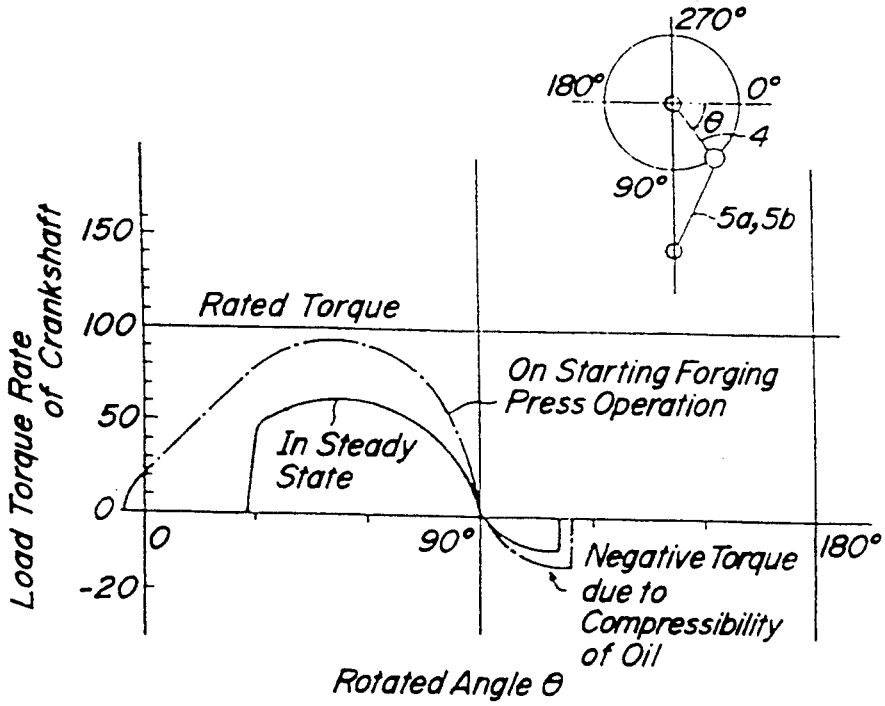
FIG. 20 is a view illustrating the relationship between the load torque and rotated angle of the crankshaft of the apparatus according to the invention.
Figure 21:
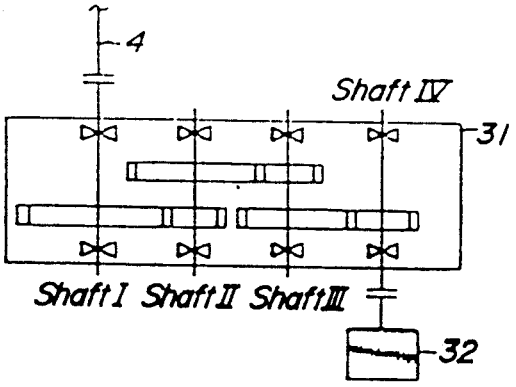
FIG. 21 is a simplified view illustrating the construction of a speed reduction device.
Figure 22:
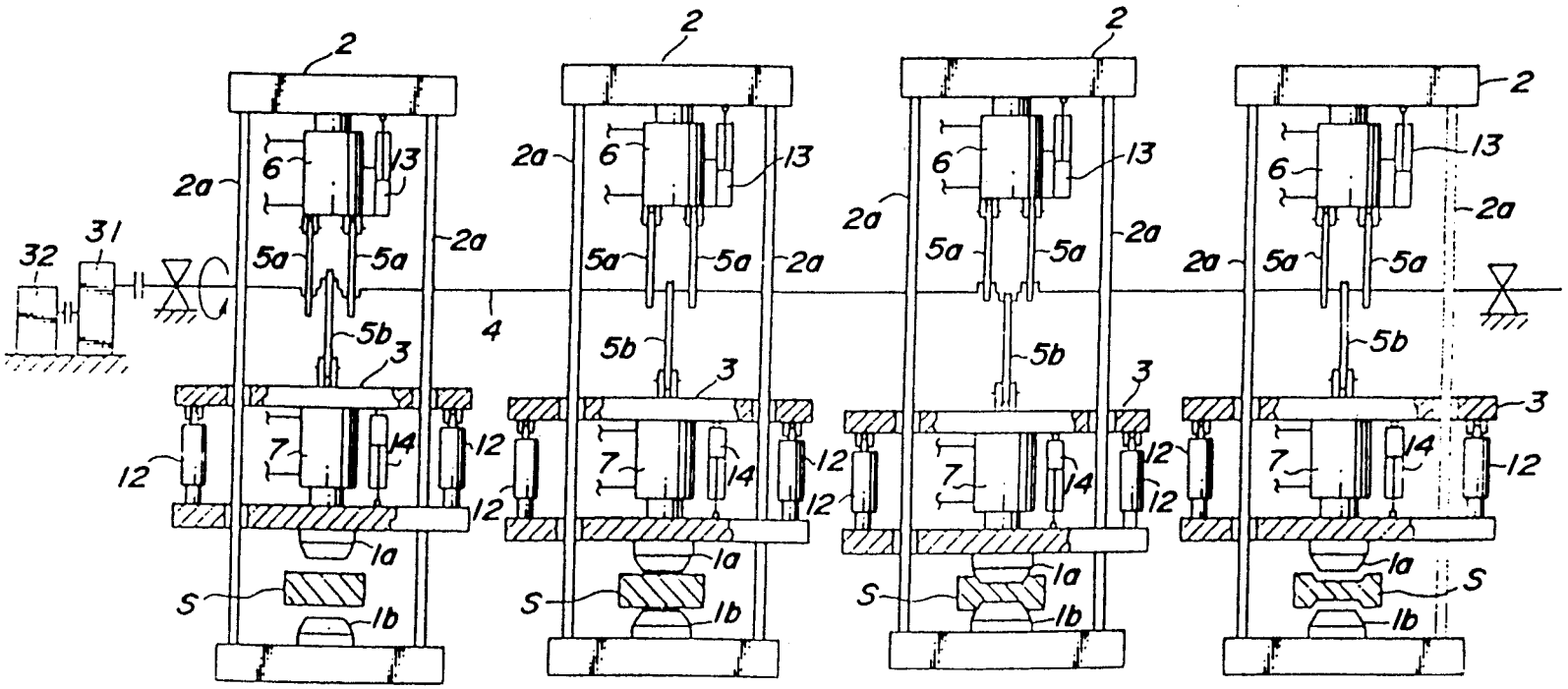
FIG. 22 is a view illustrating a further embodiment of the apparatus according to the invention.
Figure 23:
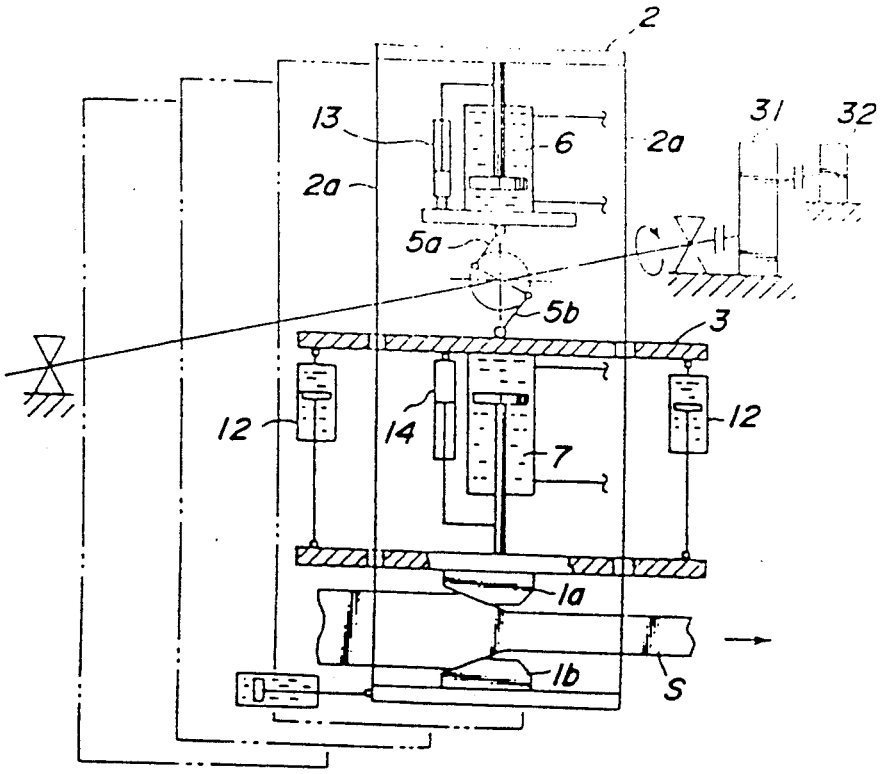
FIG. 23 is a side view illustrating the apparatus shown in FIG. 22.
Figure 24:
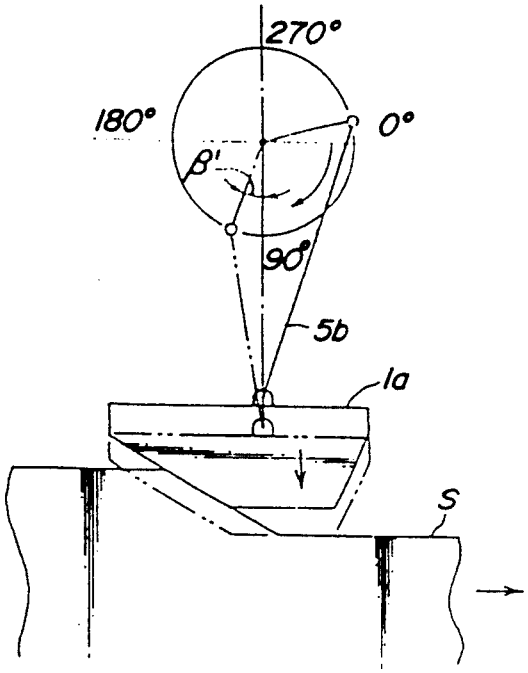
FIG. 24 is an explanatory view of a state performing the forging.
Figure 25:
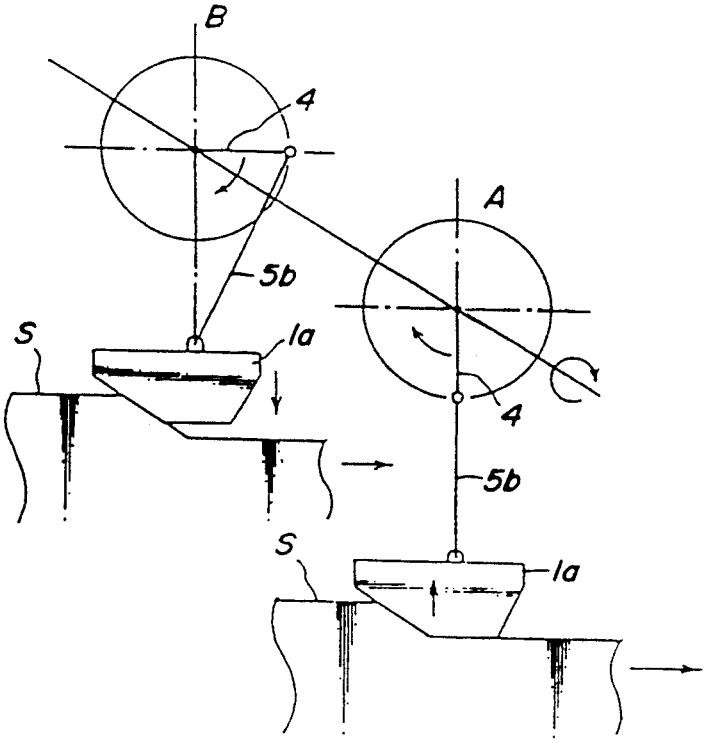
FIG. 25 is an explanatory view of a state performing the forging.
Figure 26:
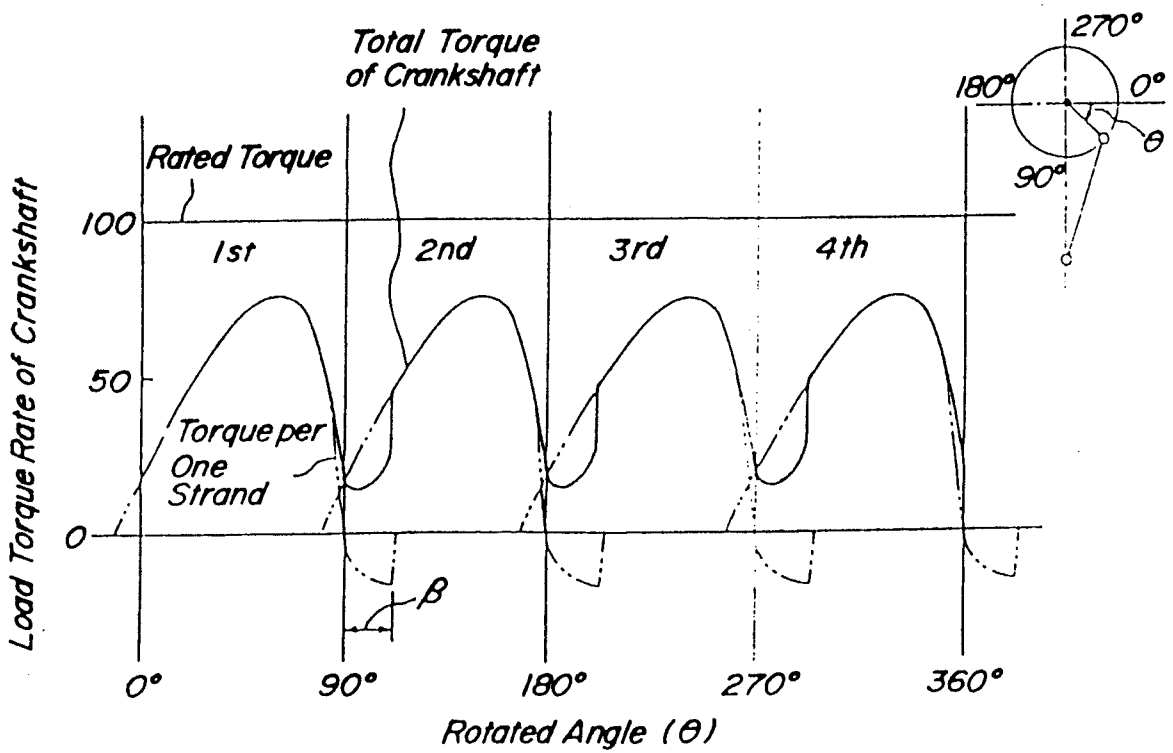
FIG. 26 is an explanatory view of a state performing the forging.

Carbon steel cast strands (0.05 to 1.0% carbon content) having a width of 340 mm and a thickness of 270 mm were produced by continuously casting and subjected to the forging by the use of the apparatus shown in FIG. 1 under the condition of reduction amount of 80 mm and forging speed of 0.9 m/min. In the forging, even if the cast strands wrapped upwardly, anvils followed the deformation of the strands. Therefore, the cast strands could be uniformly forged on their upper and lower surfaces and high internal quality strands were obtained. In this case, moreover, vibration and noise of the installation were studied depending upon whether a braking device 30 as shown in FIG. 19 was used or not. As a result, it had been found that the vibration and noise were reduced to less than one half of those without using the braking device.

Example 2

Figure 11:
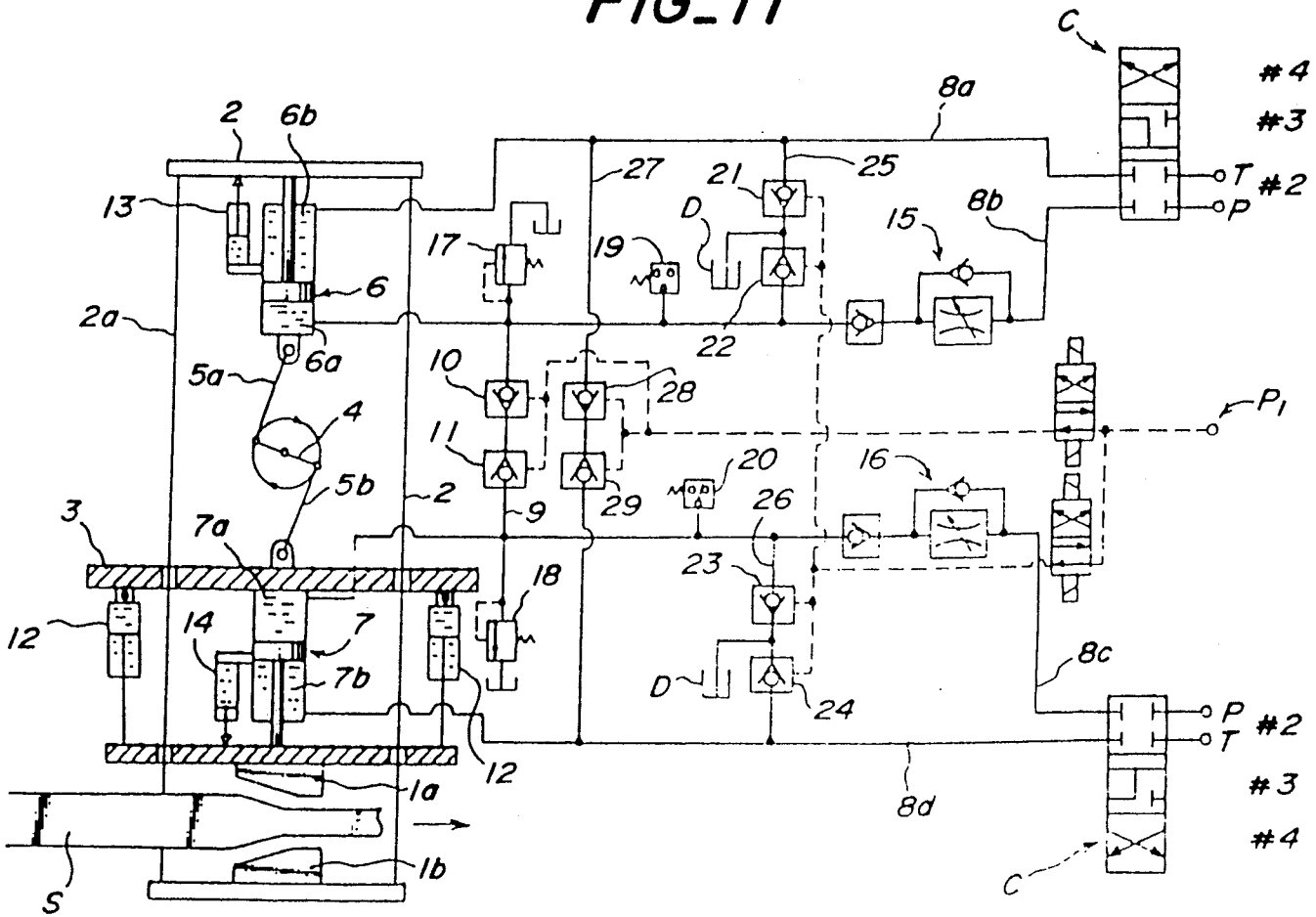
FIG. 11 is a view illustrating another embodiment of the apparatus according to the invention.
Figure 12:
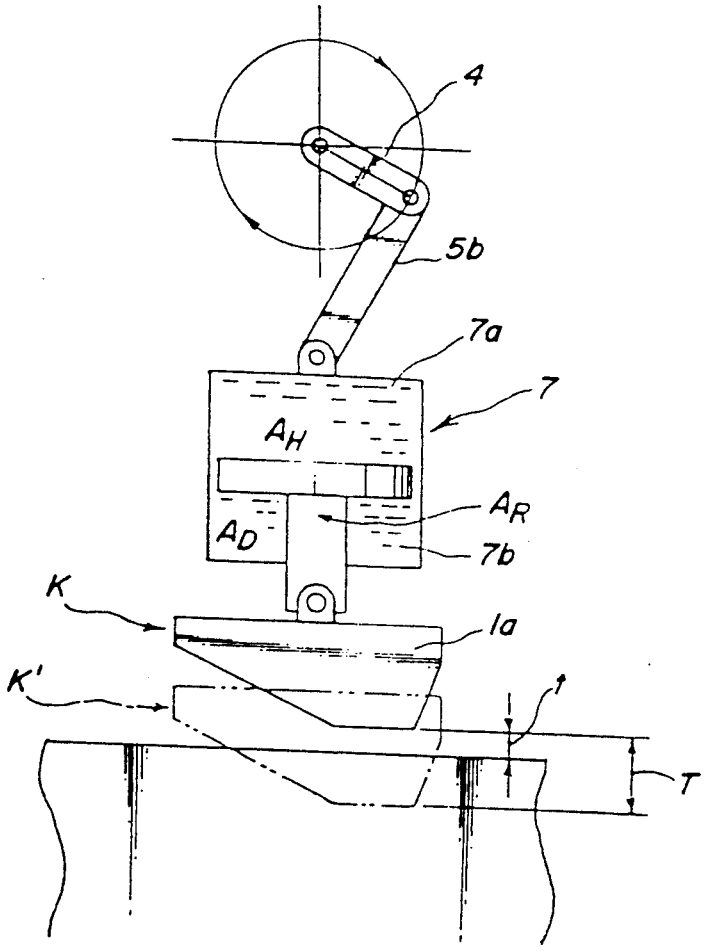
FIG. 12 is a view illustrating a section of a positioning cylinder.
Figure 13:
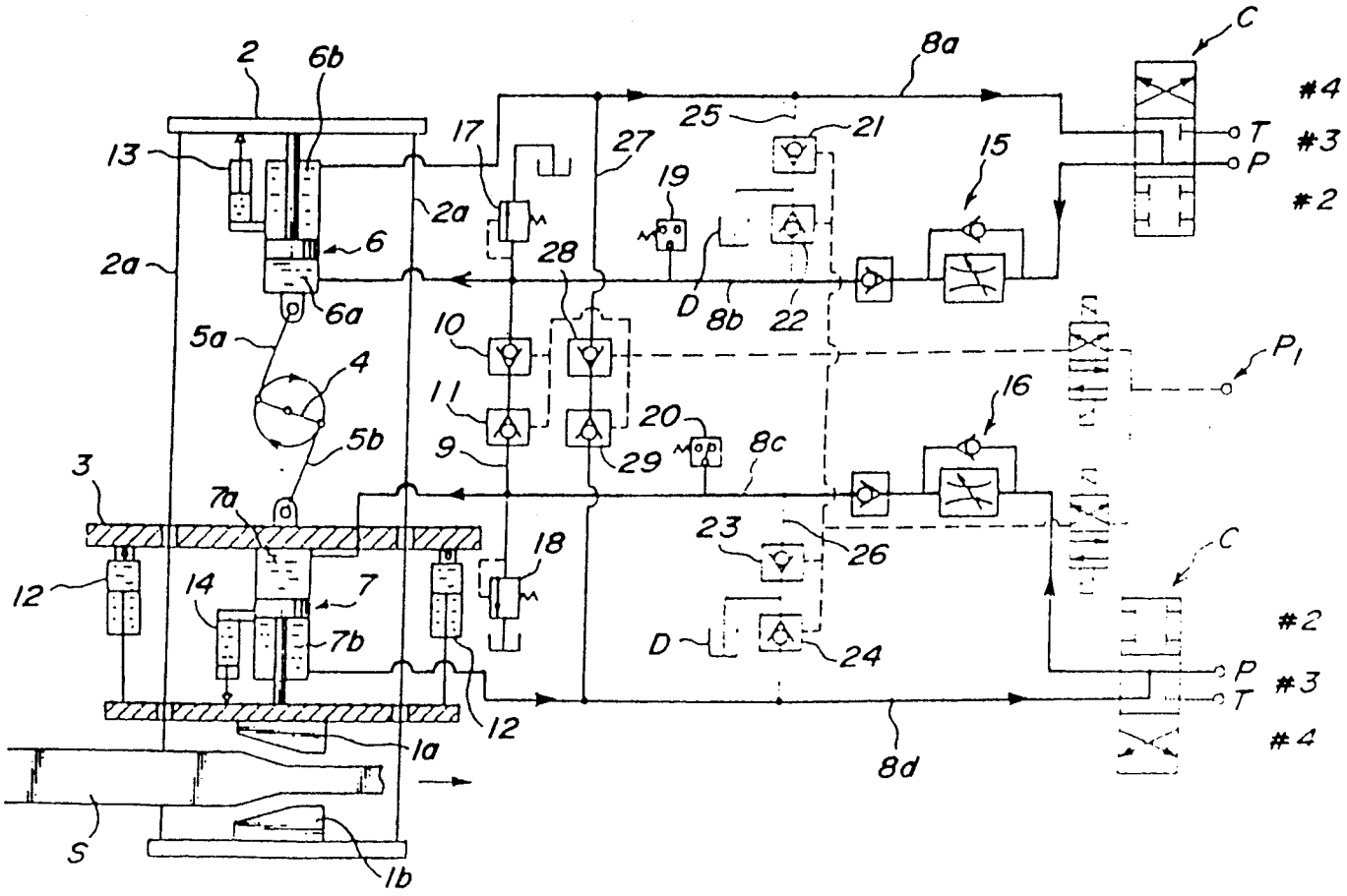
FIG. 13 is an explanatory view of the procedure of operation of the apparatus shown in FIG. 11.
Figure 14:
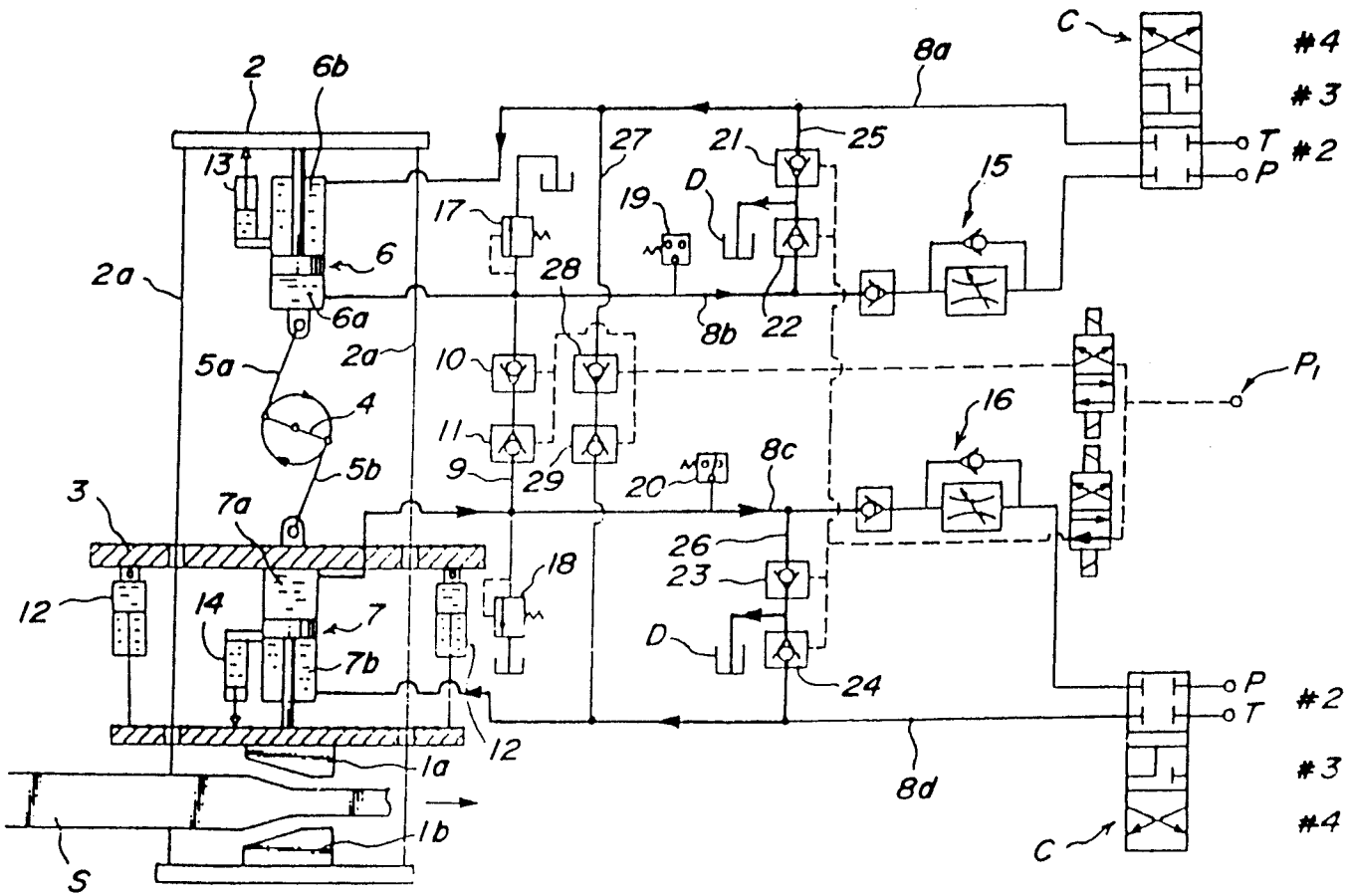
FIG. 14 is a view for explaining the procedure of operation of the apparatus shown in FIG. 11.
Figure 15:
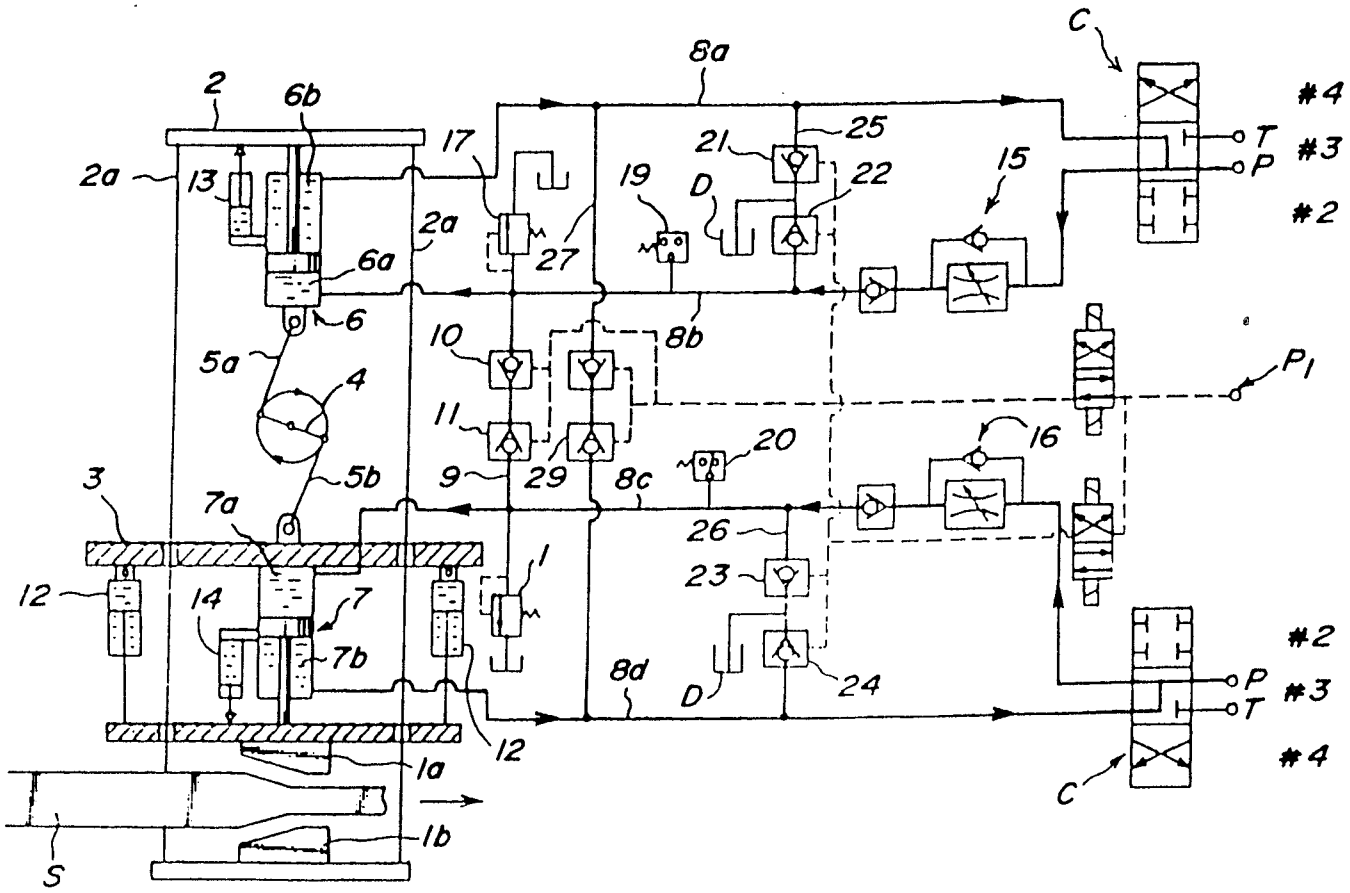
FIG. 15 is a view for explaining the procedure of operation of the apparatus shown in FIG. 11.
Figure 16:
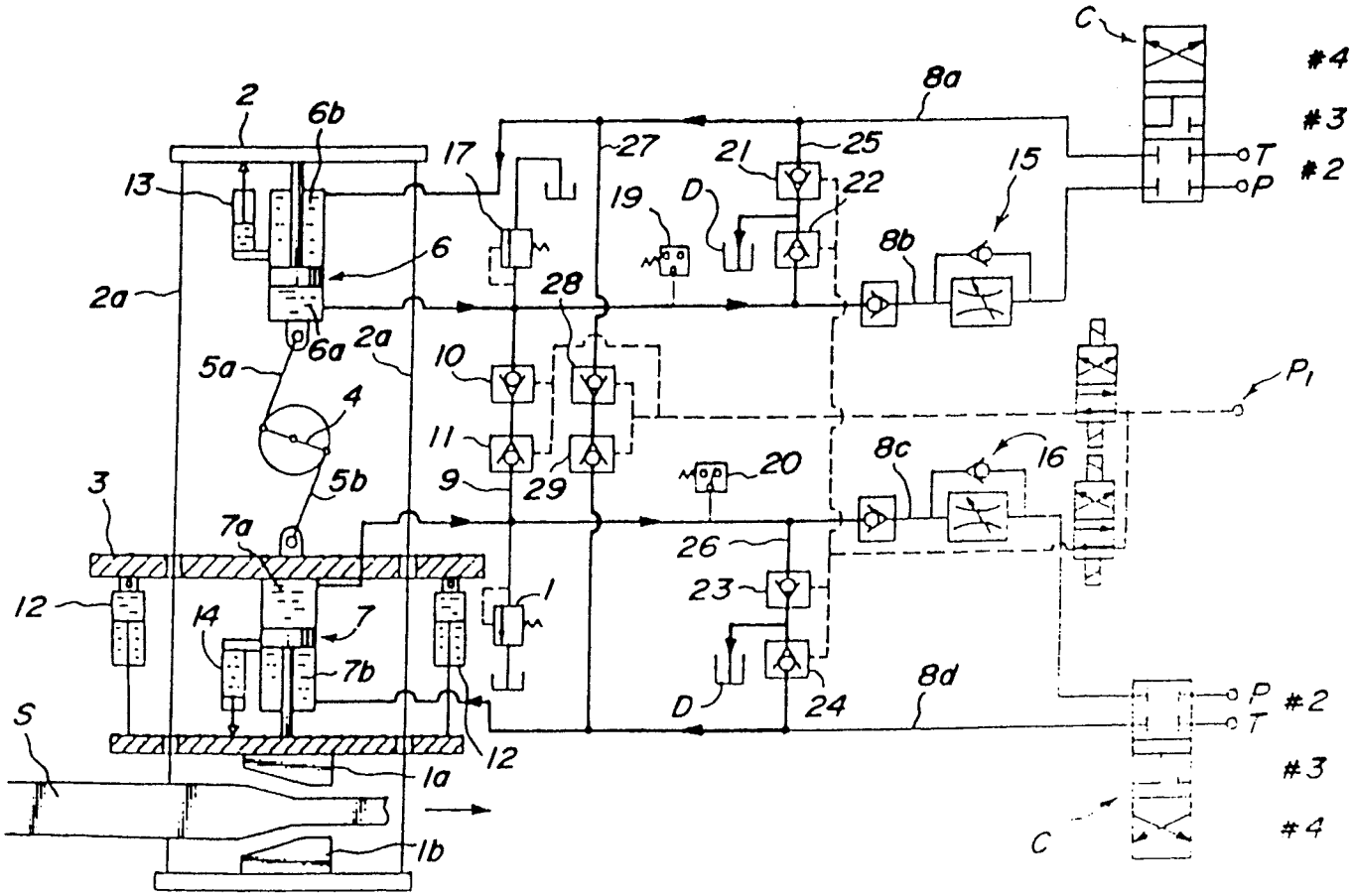
FIG. 16 is a view for explaining the procedure of operation of the apparatus shown in FIG. 11.
Figure 17:
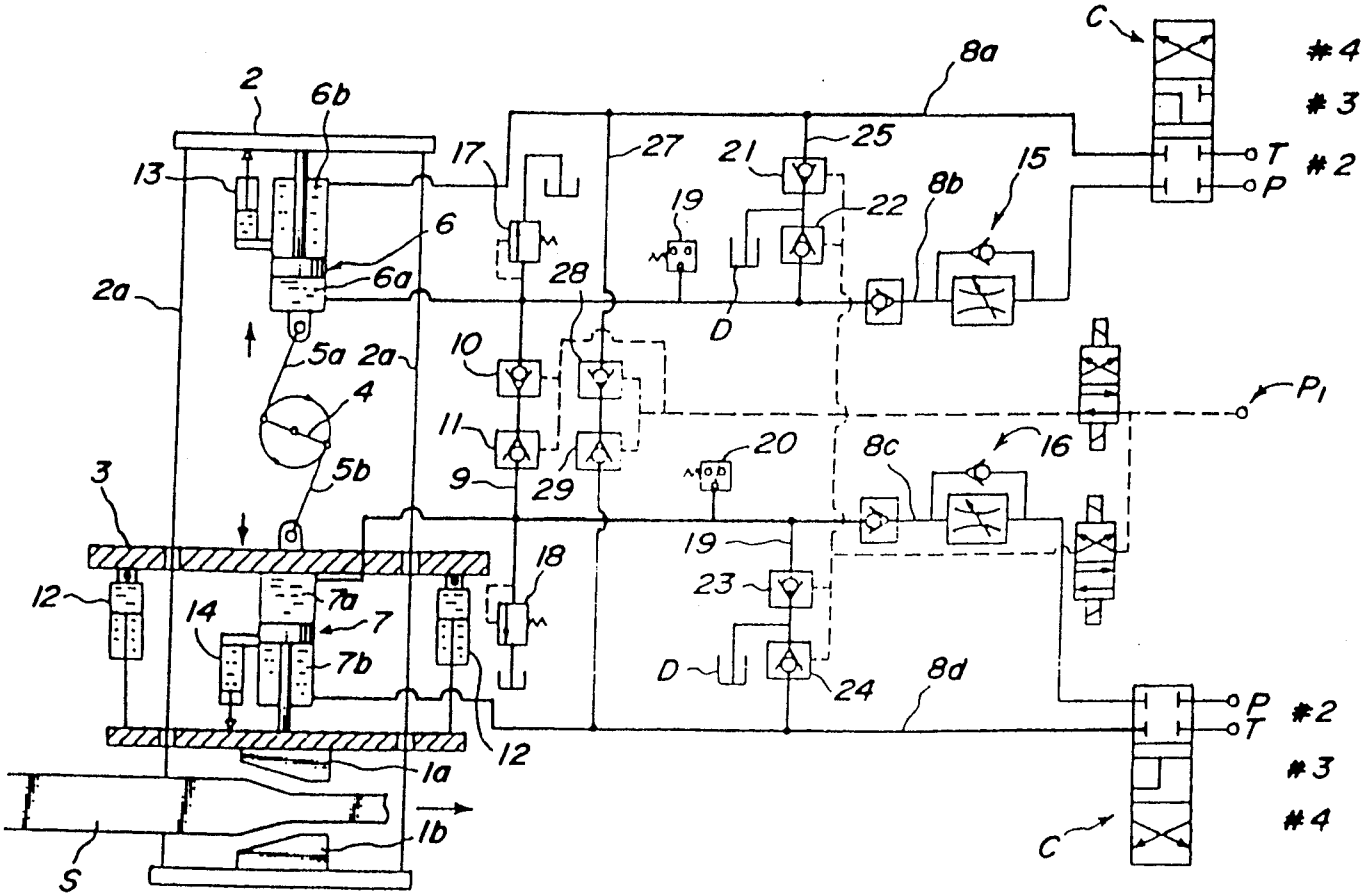
FIG. 17 is a view for explaining the procedure of operation of the apparatus shown in FIG. 11.
Figure 18:
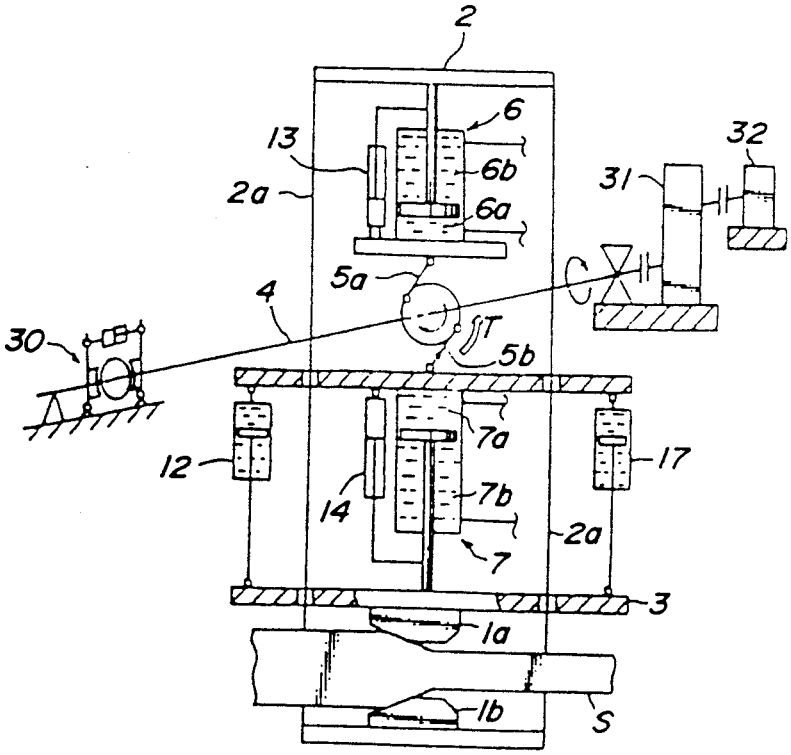
FIG. 18 is a view illustrating a further embodiment of the apparatus according to the invention.

Carbon steel cast strands (0.05 to 1.0% carbon content) having a width of 340 mm and a thickness of 270 mm were produced by continuously casting and subjected to the forging by the use of the apparatus shown in FIG. 11, and the used amounts of hydraulic oil were studied. The used amounts of hydraulic oil were also studied in the case that the forging was effected by the apparatus shown in FIG. 1.

The positioning cylinders of the forging apparatuses had a cylinder diameter of 640 mm, a rod diameter of 400 mm ($A_H=3217$ cm$^2$, $A_R=1257$ cm$^2$). The used maximum pressure of the hydraulic oil was 250 kg/cm$^2$ and the moving speed (V) of the positioning cylinders was 15 mm/s.

With the apparatus as shown in FIG. 1, the used amount of hydraulic oil was $A_H \cdot V \times 2 = 3{,}217 \times 1.5 \times 60 \times 2 \times 10^{-3} = 579$ l/min. On the other hand, with the apparatus as shown in FIG. 11, the used amount of hydraulic oil was $A_R \cdot V \times 2 = 1{,}257 \times 1.5 \times 60 \times 2 \times 10^{-3} = 226$ l/min. Therefore, it had been found that the used amount of hydraulic oil was reduced of the order of 61% in the apparatus of FIG. 11. Moreover, assuming that the cost of the hydraulic system as shown in FIG. 1 is 100, the cost of the hydraulic system as shown in FIG. 11 is about 70 and the total cost of the forging apparatus in FIG. 11 is about 92. Therefore, the cost of the installation could be reduced of the order of 8% as a whole.

INDUSTRIAL APPLICABILITY

According to the invention, when the forging is effected on a cast strand in the drawing process, the cast strand can be pressed with the uniform reduction amount on its upper and lower surfaces, even if the cast strand is deformed due to its uneven cooling. Moreover, positioning cylinders are not required to have particularly large capacity so that the apparatus ca be compactly constructed, and noise and vibration generated in the apparatus in forging can be reduced to minimum possible extent.

We claim:

1. A cast strand continuous forging apparatus including a pair of anvils for continuously forging a cast strand drawn from continuous casting molds in its final solidification region by repeated reciprocative movements of the anvils toward and away from each other on both sides of the cast strand, said apparatus comprising a main frame having one anvil fixed thereto, a subframe having the other anvil fixed thereto and movable along guide members of the main frame, a crankshaft causing the reciprocative movements of the anvils toward and away from each other, links connecting the crankshaft to the main frame and the subframe, respectively, positioning cylinders arranged on the main frame and the subframe, respectively, for adjusting the distance between the anvils, hydraulic oil passages having a selector valve and connecting a rod end oil chamber and a head end oil chamber of each of the positioning cylinders, and a first bypass line connecting the hydraulic oil passages connected to the head end oil chambers of the positioning cylinders.

2. The cast strand continuous forging apparatus as set forth in claim 1, wherein said first bypass line comprises pilot check valves.

3. The cast strand continuous forging apparatus as set forth in claim 1, wherein said apparatus comprises balance cylinders for preventing undesirable movements of the piston rods of the positioning cylinders.

4. The cast strand continuous forging apparatus as set forth in claim 1, wherein each of the positioning cylinders comprises a displacement meter for detecting displacement of the piston rod of the positioning cylinder.

5. The cast strand continuous forging apparatus as set forth in claim 1, wherein the hydraulic oil passage connected to the head end oil chamber of each of the positioning cylinders comprises a flow control valve.

6. The cast strand continuous forging apparatus as set forth in claim 1, wherein the hydraulic oil passages connected to the head end oil chamber and the rod end oil chamber of each of the positioning cylinders comprise relief valves, respectively.

7. The cast strand continuous forging apparatus as set forth in claim 1, wherein the hydraulic oil passages connected to the head end oil chamber and the rod end oil chamber of each of the positioning cylinders are connected by an hydraulic oil return circuit having pilot check valves.

8. The cast strand continuous forging apparatus as set forth in claim 7, wherein the hydraulic oil passages connected to the rod end oil chambers of the positioning cylinders are connected by a second bypass line.

9. The cast strand continuous forging apparatus as set forth in claim 7, wherein the second bypass line includes pilot check valves.

10. The cast strand continuous forging apparatus as set forth in claim 1, wherein the apparatus comprises braking means for braking the reciprocative movements of the anvils toward and away from each other.

11. The cast strand continuous forging apparatus as set forth in claim 1, wherein the apparatus comprises at least two sets of anvils different in starting time of the forging.

* * * * *